US007588145B1

(12) United States Patent
Marius

(10) Patent No.: US 7,588,145 B1
(45) Date of Patent: Sep. 15, 2009

(54) APPARATUS AND METHOD FOR EXTENDING THE LIFE OF ATHLETIC BALLS

(76) Inventor: Tamas Marius, 2080 Prescott Ave., Monterey, CA (US) 93940

( * ) Notice: Subject to any disclaimer, the term of this patent is extended or adjusted under 35 U.S.C. 154(b) by 0 days.

(21) Appl. No.: 12/231,682

(22) Filed: Sep. 6, 2008

(51) Int. Cl.
*B65D 85/58* (2006.01)

(52) U.S. Cl. ..... 206/315.9

(58) Field of Classification Search ..... 206/315.1, 206/315.9, 527; 215/321, 329, 337, 386, 215/390; 137/511, 512, 843; 220/212, 780
See application file for complete search history.

(56) References Cited

U.S. PATENT DOCUMENTS 4,019,629 A 4/1977 Dubner et al.
4,101,029 A * 7/1978 Feinberg et al. ..... 206/315.9
4,124,117 A * 11/1978 Rudy ..... 206/213.1
4,161,247 A * 7/1979 Feinberg et al. ..... 206/315.9
4,428,478 A 1/1984 Hoffman
4,450,667 A 5/1984 Fitzpatrick
5,002,196 A 3/1991 Bassili
5,014,848 A 5/1991 Wild et al.
5,044,495 A * 9/1991 Wyslotsky ..... 206/315.9
5,311,988 A 5/1994 Bronson
5,397,018 A 3/1995 Mader
5,469,979 A 11/1995 Chiou
5,615,596 A 4/1997 Issa
5,730,286 A 3/1998 Eska
5,848,690 A 12/1998 Granger et al.

* cited by examiner

*Primary Examiner*—Jacob K Ackun, Jr.

(57) ABSTRACT

An improved apparatus and method for extending the life of tennis balls and the like by storing the athletic balls in a pressurized portable container having protected inlet and relief valves embedded in the body of the container.

18 Claims, 5 Drawing Sheets

APPARATUS AND METHOD FOR EXTENDING THE LIFE OF ATHLETIC BALLS

FEDERALLY SPONSORED RESEARCH

Not Applicable

SEQUENCE LISTING OR PROGRAM

Not Applicable

BACKGROUND

1. Field of the Invention

The present invention generally relates to the field of pressurized containers. More particularly, the present invention relates to the field of pressurized containers used to store and re-pressurize tennis balls, racket balls, squash balls, basketballs, and the like.

2. Description of the Prior Art

Athletic balls used in games such as tennis, squash, racket ball, basketball, and the like are typically hollow, spherical in shape, and composed of rubber or a rubber-like material. These athletic balls are typically pressurized and, as such, will readily bounce off of a sports racket or the floor and walls of the court in or upon which the game is being played. Over time and through repetitive use, these athletic balls lose will gradually lose air through the process of osmosis which causes them to depressurize. When athletic balls depressurize, they soften and lose their resilience or, in more general terms, they lose their "bouce." As a result, these athletic balls have a relatively short useful life and the user will eventually and continually have to replace them with newer, fresher athletic balls.

This problem of athletic balls losing pressure has been partially solved by sporting goods manufacturers who market these athletic balls in pressurized cans or containers. While stored under pressure, the athletic balls will not depressurize because the pressure in the can is equal to or greater than the pressure inside the ball. In fact, the athletic balls will not begin to depressurize until the storage container is opened and the athletic balls are put into play. The prior art has numerous examples of devices that use pressurized containers to slow down this depressurization or, in many cases, actually re-pressurize the athletic ball once it has been used.

For example, U.S. Pat. No. 4,019,629 issued to Dubner et al. (1977) discloses a pressurized tennis ball container comprised of a separate cap with a hand-pump and one or more externally-mounted valves attached thereto. The cap screws onto a cylindrical threaded collar surrounding the top edge of a standard tennis ball container. The invention disclosed by Dubner et al. is similar to several others in the prior art that contemplate placing all of the external fixtures (valves, gauges, connections, etc.) on a removable cap that is somehow attached to the rim located at the top of a standard tennis ball container.

Similarly, U.S. Pat. No. 4,428,478 issued to Hoffman (1984) discloses a self-sealing pump for use in sealing and pressurizing a container for tennis balls. This device, like the device disclosed by Dubner et al., contemplates a separate cap with a hand-pump and one or more externally mounted valves attached thereto. This cap also screws onto a cylindrical threaded collar placed around the top of a standard tennis ball container.

U.S. Pat. No. 4,450,667 issued to Fitzpatrick (1984) discloses an apparatus and method for rejuvenating worn or used balls by subjecting them to steam heat in a closed environment. This device uses an external source of heat to pressurize athletic balls as opposed to an attached air pump or air compressor to pressurize the container.

U.S. Pat. No. 5,002,196 issued to Bassili (1991) discloses a pressure vessel having a removable lid for storing objects under pressure. This invention was designed to accommodate the pressurization of numerous tennis balls in a single location trough the use of an electric air compressor attached to the pressure vessel. This invention permitted the user to pressurize a larger number of tennis balls than the three typically found in a standard, commercially distributed container. Bassili also disclosed a removable lid to form an airtight seal with the pressure vessel by means of an O-ring or PVC gasket.

U.S. Pat. No. 5,014,848 issued to Wild et al. (1991) discloses a portable device for storing multiple tennis balls under pressure. This device is similar to the pressurized ball containers disclosed by Dubner et al. and Hoffman in that it is constructed with a hand-pump physically attached to the exterior surface of the tennis ball container.

U.S. Pat. No. 5,311,988 issued to Bronson (1994) discloses a pressurizing cap that fits over a conventional tennis ball container. This portable, inexpensive device relies upon the downward movement of the cap to compress the air trapped inside to pressurize the tennis ball container; in essence, the cap acts as a piston to compress the air in the container.

U.S. Pat. No. 5,397,018 issued to Mader (1995) discloses a tennis ball handling system that has two storage systems. One storage system is quite complex and remains in a fixed location while the other, the player's storage container is much simpler in design and it is also portable. The player's storage container is comprised of a portable cylindrical container, a removable screw-on cap with input and relief valves placed thereon, and an external pressurizing source.

U.S. Pat. No. 5,615,596 issued to Issa (1997) discloses an inflated ball container and re-pressurizer that fit over the open end of a tennis ball container and forces compressed air into the closed container when the diaphragm on the cap is depressed. This device is quite similar in concept to the devices disclosed by Dubner et al. and Hoffman in that it uses a pressurizing source that is attached to the storage container.

U.S. Pat. No. 5,730,286 issued to Eska (1998) discloses a container with a pressure vessel for regenerating and storing tennis balls. Eska discloses a device comprised of a portable, cylindrical chamber, with a removable screw-on cap with valves integrated into the cover itself, and an input connection located in the base of the container. The device disclosed by Eska contemplates the use of a hand-pump attached to the tennis-ball container or an external source, such as an air compressor.

In another field, U.S. Pat. No. 5,469,979 issued to Chiou (1995) discloses an adjustable sealed can that uses an attached hand-pump to withdraw air from the container through a valve screwed into a threaded hole in the container's removable screw-on top.

Cumulatively, these devices have made significant headway in addressing the problem of athletic balls losing their bounce. Successive inventors have built upon the lessons learned by their predecessors so as to disclose improved pressurized containers that are portable, more affordable, and more durable. That said, there remain several issues and problems that have not been adequately addressed by the prior art, both individually and collectively. Specifically:

(1) Most, if not all, of the devices found in the prior art are complex in design and construction and are difficult and complicated to operate. This makes them expensive to manufacture which, in turn, makes them expensive for the consumer to purchase. Further, these complex designs typically give rise to increasingly larger numbers of breakable parts. The parts must be replaced or the user must purchase an entirely new device either of which represents a significant increase in their cost to the consumer.

(2) Most, if not all, of the devices found in the prior art contain or rely upon specially or uniquely designed or fabricated valves, fixtures, gauges, and other such attachments. This makes these devices expensive because these specially designed valves, fixtures, and gauges must be engineered and manufactured separately which adds significantly to the cost of such devices. These increased manufacturing costs are passed on to the consumer Further, these specially designed or fabricated attachments typically give rise to increasingly larger numbers of breakable parts which, again, increases the cost of the device to the consumer who must repair or replace the broken parts or purchase a new device altogether.

(3) Most, if not all, of the devices found in the prior art contain fixtures, valves, and the like attached to a removable cap that would fit over a pressurized container. Further, these fixtures and valves typically extend vertically and outward from the surface of these removable caps. Such a configuration subjects these fixtures, valves and the like to an increased risk of breaking, bending, snapping-off, misalignment, or other such damage as the cap is repeatedly taken off the container, set aside somewhere, and then replaced. Further still, the cap, as it is repeatedly removed, set down, and reattached, is at risk of being dropped, jarred, shaken, stepped on, or otherwise knocked around physically. Any of these actions could damage, misalign, distort, or otherwise render ineffective the attachments in or on this removable cap.

(4) Most of the devices found in the prior art contain fixtures, valves, and the like attached to a removable cap that would fit over a pressurized container. This removable cap could be easily misplaced or stolen which would require the user to incur the expense of purchasing another such device or doing without.

(5) Most of the devices found in the prior a have some type of pumping mechanism physically attached to the athletic ball container. Having a pressurizing device such as a hand-pump physically attached to these devices adds to their complexity and expense of its design, manufacture, and operation which, in turn, makes them more expensive to the consumer. Further, the use of an attached hand-pump requires the user to move the piston or pump handle up and down in the vicinity of the container, making it awkward and difficult to move. Finally, the use of an attached hand-pump often requires a customized can to accommodate the hand-pump.

(6) Most of the devices disclosed in the prior art are limited in size to fit over a standard tennis ball container or to accommodate only tennis balls. Further, they are typically limited to use with containers made of a lightweight, malleable metal which, as previously mentioned, is often susceptible to deformation or other such damage leading to leakage.

(7) Most, if not all, of the devices disclosed in the prior art require the use of gaskets or other such pliable, elastic materials to effect an airtight seal between the lid and the athletic ball container. These gaskets will eventually deteriorate and fail. As such, the gaskets have to be replaced which ultimately adds to the costs endured by the consumer who uses these devices.

(8) Most, if not all, of the devices disclosed by the prior art have fixtures, valves, and the like which are exposed to dirt, dust, water intrusion, and other such contaminants that negatively impact the operability of such fixtures and valves and that will eventually cause them to deteriorate. Such deterioration renders the device ineffective or useless and thereby requires the user to repair or replace the damaged valves, purchase another such device, or do without.

(9) Most, if not all, of the devices disclosed by the prior art contemplate the use of a standard, commercially distributed tennis ball canister that contains only three tennis balls. They cannot accommodate more than three tennis balls and they cannot accommodate other types of athletic balls.

(10) Most, if not all, of the devices disclosed by the prior art contemplate a device designed to pressurize tennis balls. As such, their design and construction precludes their use in pressurizing other types of athletic balls.

(11) Most, if not all, of the devices disclosed by the prior art contemplate the use of materials that have a relatively low compression strength which makes them susceptible to damage when an attached hand-pump is used to pressurize the device.

(12) Most, if not all, of the devices disclosed by the prior art are limited to either an external source of compressed air or an attached source of compressed air (such as a hand-pump).

(13) Most, if not all, of the devices disclosed by the prior art are unstable and tend to tip over because of the numerous attachments, valves, and the like positioned near the top of the device.

(14) Many of the devices disclosed by the prior art are bulky, cumbersome, and difficult, if not impossible, to carry from place to place.

OBJECTS AND ADVANTAGES

The object of the present invention is to address the foregoing problems and to provide an improved apparatus and method for extending the life of tennis balls and the like by storing these athletic balls in a simple, low-cost, and portable pressurized container having protected inlet and relief valves embedded in the body of the container as opposed to the container's cap or cover. Specifically, it is an object of the present invention:

(1) to provide an improved apparatus for pressurizing, a container of athletic balls that is simple in design and operation, easy and inexpensive to manufacture, manufactured with off-the-shelf materials, easy to operate, and commercially reasonable in price.

(2) to provide an improved apparatus for pressurizing a container of athletic balls that has a minimum number of moving parts.

(3) to provide an improved apparatus for pressurizing a container of athletic balls that has all of its fixtures, valves, and the like embedded in the bottom of the container itself so as to minimize their exposure to risk of damage from bending, breaking, snapping off, being dropped, being shaken, tipping over, or being jarred.

(4) to provide an improved apparatus for pressurizing a container of athletic balls that uses products that are durable and resistant to deformation.

(5) to provide an improved apparatus for pressurizing a container of athletic balls that is easily transportable from one location to another.

(6) to provide an improved apparatus for pressurizing a container of athletic balls that does not require the use of rubber or rubber-like material gaskets to maintain an air-tight seal.

(7) to provide an improved apparatus for pressurizing a container of athletic balls that protects the fixtures, valves, and the like imbedded therein from exposure to dirt, dust, water, and other such forms of contamination.

(8) to provide an improved apparatus for pressurizing a container of athletic balls that is not limited in the number or size of athletic balls contained therein.

(9) to provide an improved apparatus for pressurizing a container of athletic balls that is simple and safe to operate.

(10) to provide an improved apparatus for pressurizing a container of athletic balls that can use multiple sources of pressurization.

(11) to provide an improved apparatus for pressurizing a container of athletic balls that has a minimum number of fixtures attached thereto.

(12) to provide an improved apparatus for pressurizing a container of athletic balls that minimizes the risk of damage to or loss of the valves, fixtures, gauges, and other such attachments necessary to safely pressurize such a container.

Additional objects, advantages, and novel features of the invention will be set forth in part of the description which follows and will become apparent to those skilled in the art upon examination of the following specification, or will be learned through the practice of the present invention.

SUMMARY

The present invention is an improved apparatus and method for extending the life of tennis balls and the like by storing such athletic balls in a pressurized portable container having protected inlet and relief valves embedded in the body of the container itself. The present invention represents a significant improvement over those inventions disclosed in the prior art by:

(1) using an external source to pressurize the container.

(2) minimizing the risk of damage to the attached or embedded fixtures, valves, gauges, and the like by embedding such fixtures in the body of the container instead of the removable cap or cover.

(3) fully protecting the fixtures, valves, gauges, and the like from contamination by dirt, dust, water, and the like.

(4) eliminating the use of gaskets to maintain an airtight seal.

(5) using off-the-shelf components for fixtures, valves and the like instead of complex, specially designed attachments.

These improvements provide the user with a device that is easier to operate and more affordable than similar devices disclosed by the prior art. The present invention is simple in design and construction which makes it easy to use and economical to manufacture. The present invention uses off-the-shelf components which, again, make it economical to manufacture. Finally, the present invention minimizes the exposure of vital components to damage which, in turn, extends the useful life of the device and thereby, presents a significant saving to the user who is no longer faced with necessity of replacing the device.

DRAWINGS

Drawing Figures

REFERENCE NUMERALS IN DRAWINGS

Figure 1:
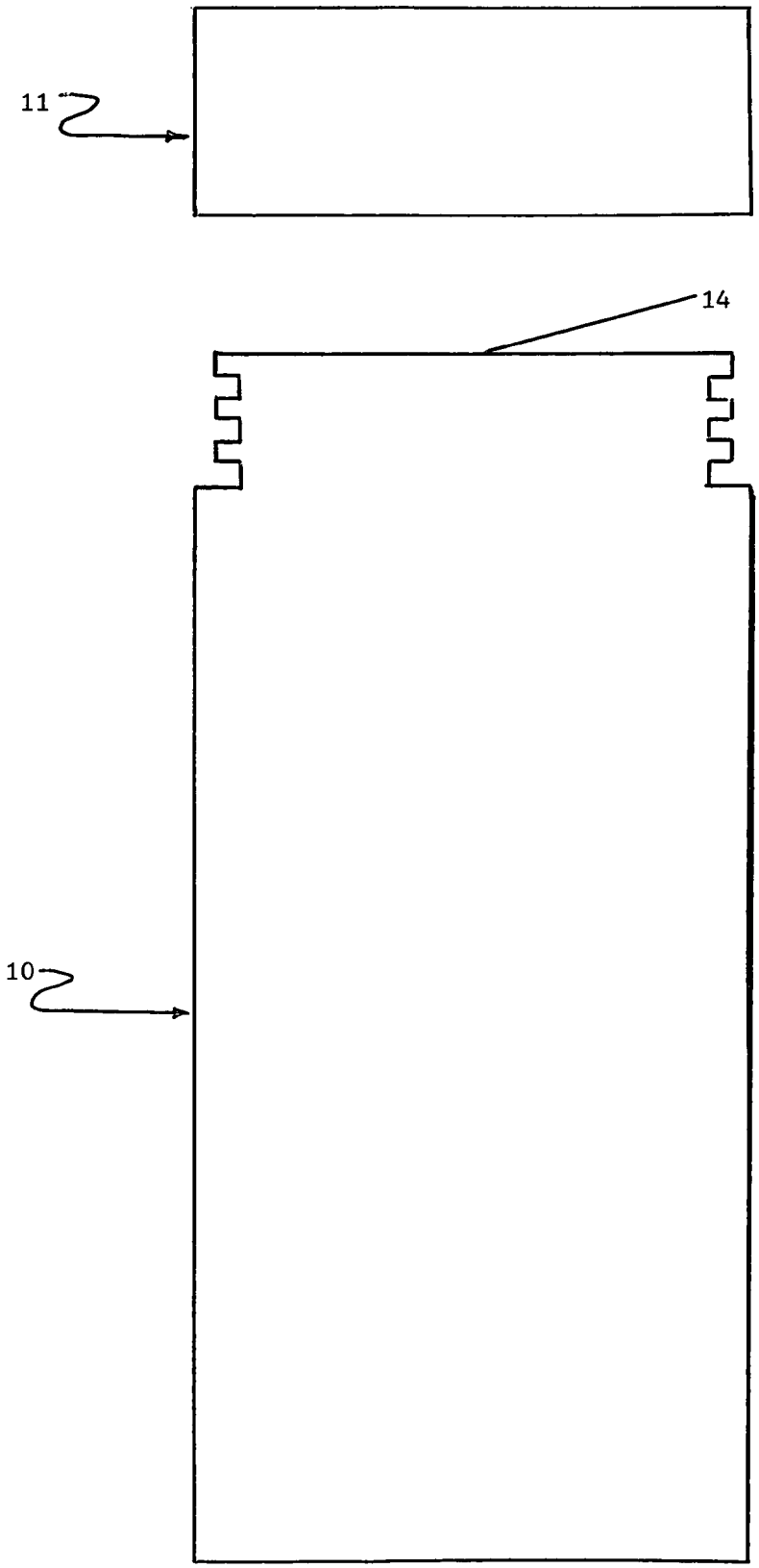
FIG. 1 is a side view of the present invention.
Figure 2:
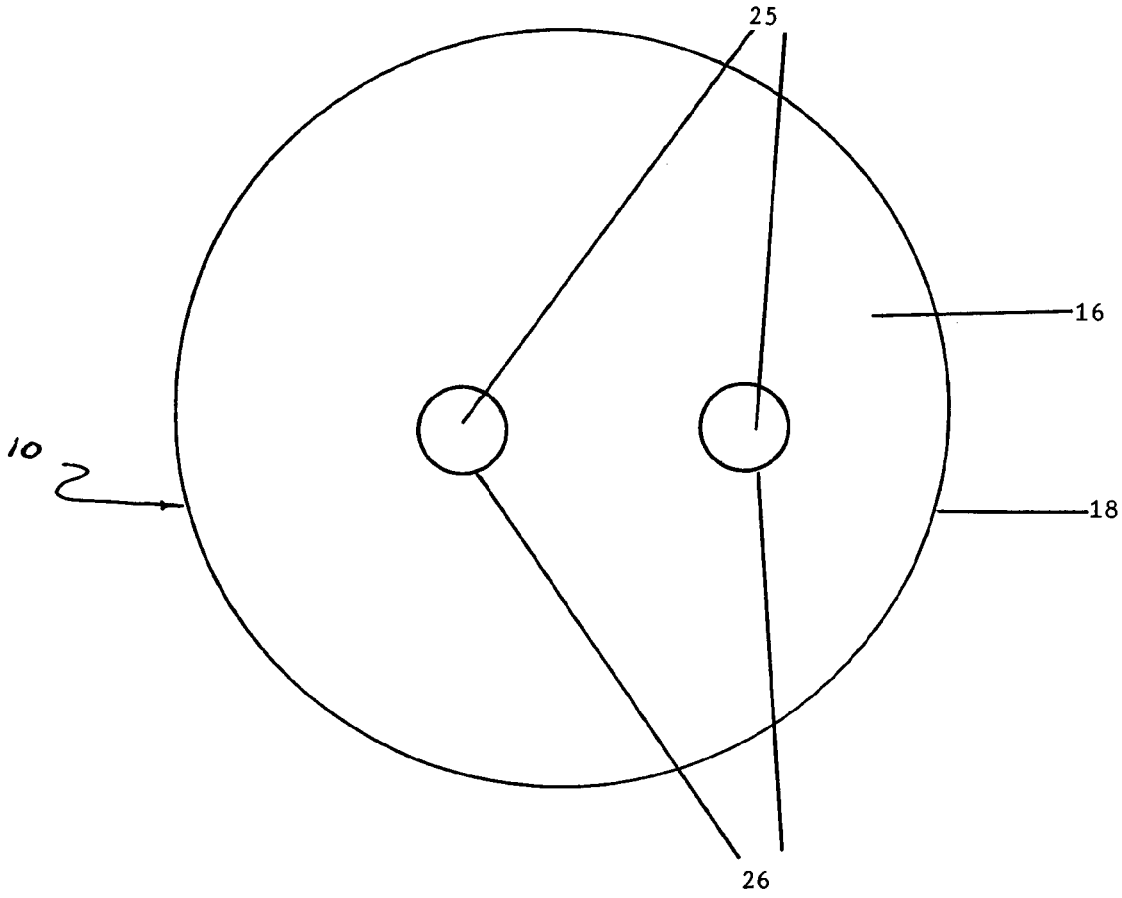
FIG. 2 is a bottom-up plan view of the present invention.
Figure 3:
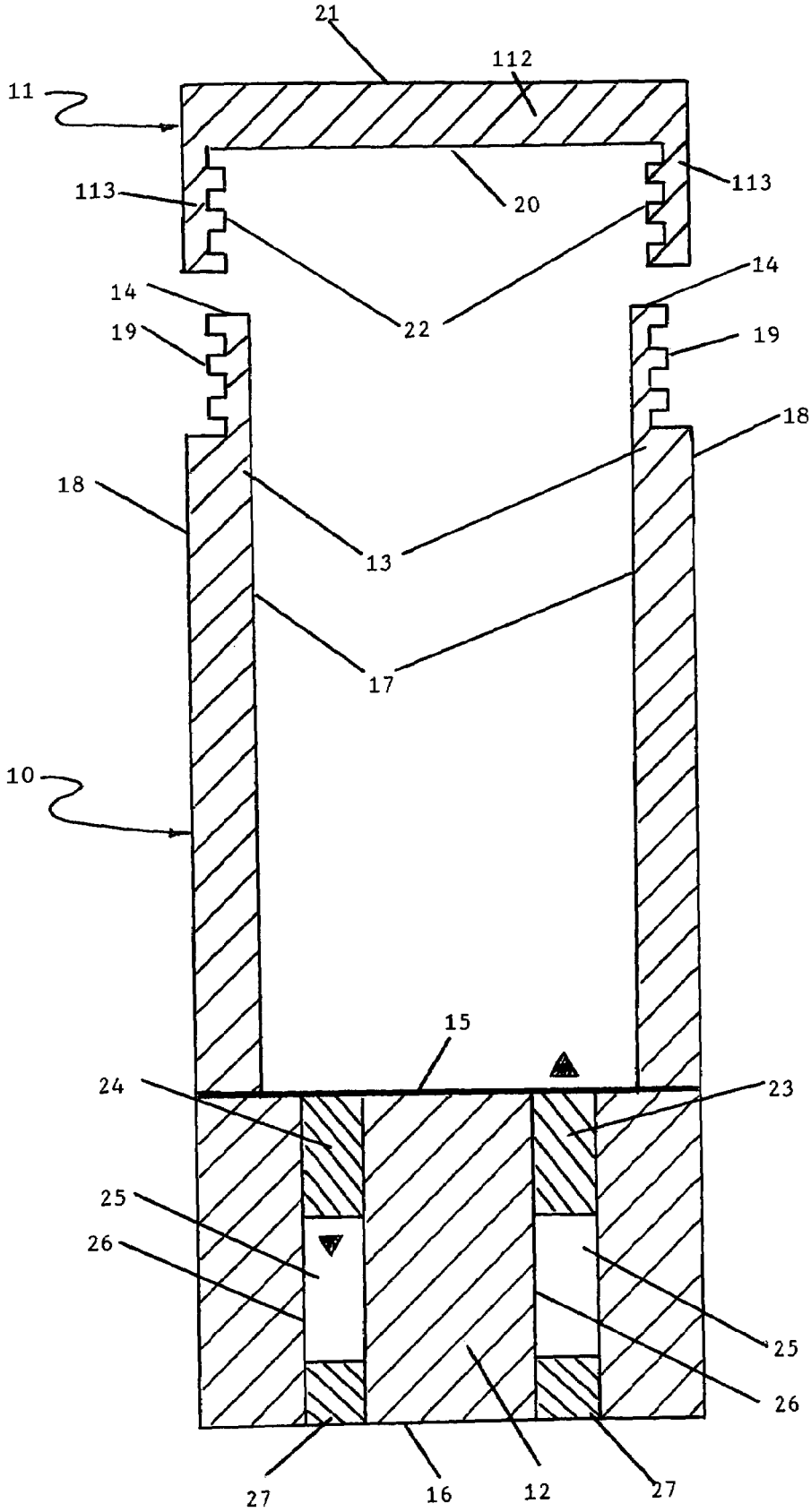
FIG. 3 is a cross-sectional view the preferred embodiment of the present invention.

10—Container
11—Cover
112—Cover top wall
113—Cover side wall
12—Bottom wall
13—Side wall
14—Top end
15—Bottom wall inner surface
16—Bottom wall outer surface
17—Side wall inner surface
18—Side wall outer surface
19—External male threads
20—Screw-on cover inner surface
21—Screw-on cover outer surface
22—Internal female threads
23—Inlet valve
24—Relief valve
25—Valve hole
26—Valve hole sides
27—Valve cover
28—Access passage
29—Egress passage
30—Attached internal gas pump
31—Attached external gas pump

DESCRIPTION OF THE INVENTION

Athletic balls used in games such as tennis, squash, racket ball, basketball, and the like are typically hollow, spherical in shape, and composed of rubber or a rubber-like material. During the manufacturing process, these athletic balls are typically pressurized so that they will exhibit elastic resiliency ("bounce") while being used. However, because these balls are pressurized, the air inside will gradually seep out through the material composing the ball through the process of osmosis. When this happens, the athletic balls lose their bounce, which renders them unsuitable for continued use.

It is possible, however, to rejuvenate these depleted athletic balls by storing them in a closed container that is then pressurized. Because the pressure in the container is greater than the pressure inside the athletic ball, the air inside the athletic ball will no longer leak out. In fact, because of the overpressure in the container, the air in the container is, through the process of reverse osmosis, forced back into the athletic balls until the pressure inside the athletic balls is equal to the pressure in the container. This process restores the bounce to the athletic balls stored therein and thereby greatly extends their useful life.

DESCRIPTION

Preferred Embodiment

Referring to FIGS. 1-4, the preferred embodiment of the present invention includes a hollow cylindrical container 10 and a removable cylindrical cover 11 that creates an airtight seal between the container 10 and the cover 11 when the cover 11 is attached thereto. The container 10 is preferably molded and uniformly cast from a lightweight and durable metal such as aluminum or tin. However, the container 10 could also be molded and uniformly cast from a number of other lightweight and durable materials such as plastic, vulcanized rubber, and the like. Similarly, the cover 11 is preferably molded and uniformly cast from a lightweight and durable metal such as aluminum but could also be molded and uniformly cast from other lightweight and durable materials such as plastic, vulcanized rubber, and the like. Casting the container 10 and the cover 11 from the same material is economical and efficient but casting the container 10 and the container 11 from different materials is also an option depending upon the needs of the user. By way of example, the user may prefer a transparent container 10 which would suggest using plastic or Plexiglas in making the container 10, whereas a cover 11 of the same material would not necessarily be required.

The container 10 has a generally circular bottom wall 12, a generally cylindrical side wall 13, and an open top end 14. The bottom wall 12 has an inner surface 15 and an outer surface 16. Similarly, the side wall 13 also has an inner surface 17 and an outer surface 18. The outer surface 18 of the side wall 13 in the preferred embodiment has external male threads 19 machined, molded, or cast thereon adjacent to the top end 14

As stated previously, the container 10 is preferably molded and uniformly cast from a lightweight and durable metal such as aluminum but could also be molded and uniformly cast from other lightweight and durable materials such as plastic, vulcanized rubber, and the like. It is also feasible to cast the bottom wall 12 and the side wall 13 separately and then attach the side wall 13 to the bottom wall 12 using an appropriate thermal, mechanical, or chemical fusion procedure. Casting the bottom wall 12 and the side wall 13 separately allows the user the option of having the bottom wall 12 and the side wall 13 composed of identical materials or dissimilar materials.

Lastly, the cover 11 is generally cylindrical in shape with a generally circular cover top wall 112 closing off one end of the cover 11 and a generally cylindrical cover side wall 113 extending downward from the periphery of the cover top wall 112. These features give the cover 11 a shallow and hollow cylindrical shape that is roughly the same diameter as the container 10 thereby permitting the user to completely and tightly close the container 10 with the cover 11. Accordingly, the cover 11 has an inner surface 20 and an outer surface 21. The inner surface 20 of the cover side wall 113 found in the preferred embodiment of the present invention has internal female threads 22 machined, molded, or cast thereon so as to easily engage and mate with the external male threads 19 found on the container's 10 side wall outer surface 18 when the user places the cover 11 on the container 10 and twists the cover 11 in a clockwise direction.

Attaching the cover 11 to the container 10 in this manner provides an airtight seal between the cover 11 and the container 10. This screw-on cover 11 is the preferred method of maintaining an airtight seal between the container 10 and the cover 11 but other variants of the present invention contemplate the use of "snap-on" caps, interlocking teeth, gaskets, temporary sealants, and the like to maintain the airtight seal between the container 10 and the cover 11. The airtight seal allows the container 10 and the athletic balls stored therein to remain pressurized.

An inlet valve 23 and a relief valve 24 are each inserted into a generally circular valve hole 25 extending all the way through the bottom wall 12 so as to create an airtight seal between each valve 23, 24 and the valve hole sides 26 of its respective valve hole 25. The inlet valve 23 and the relief valve 24 are both securely imbedded in the bottom wall 12 in an airtight manner and so that no portion of either valve extends below the plane of the outer surface 16 of the bottom wall 12. The inlet valve 23 is typically an off-the-shelf variety valve such as the type found on a bicycle tire, automobile tire, inflatable mattress, inflatable life vest, and the like that will easily connect to a hose leading from an external air compressor. The relief valve 24 is also a typically off-the-shelf variety one-way valve that will open at a predetermined air pressure set point to prevent an excessive build up of air pressure inside the closed container 10.

Embedding the inlet valve 23 and the relief valve 24 in the bottom wall 12 in this manner protects the valves from damage or breakage typically experienced by valves that protrude. Further, embedding the valves 23, 24 in the bottom wall 12 instead of the cover 11, which is typical of the devices disclosed by the prior art, significantly reduces the exposure of these valves to risk of damage or breaking by being dropped, jarred, shaken, kicked, stepped on, or otherwise mistreated. Although the preferred embodiment only contemplates embedding an inlet valve 23 and a relief valve 24 in the bottom wall 12, other, more complex variations contemplate embedding additional valves, fixtures, and gauges in the bottom wall 12 as well. These additional valves, fixtures, and gauges include, without limitation, items such as a pressure gauge and additional inlet valves to accommodate multiple sources of pressurization. These additional valves, fixtures, and gauges, like the inlet valve 23 and the relief valve 24 disclosed by the preferred embodiment, would also be embedded in the bottom wall so that they do not extend below the plane of the outer surface 16 of the bottom wall 12.

Finally, a generally cylindrical uniformly cast and solid valve cover 27 composed of a soft, elastic material is permanently inserted into the valve hole 25 running through the bottom wall 12. The valve cover 27 is composed of a soft, durable, elastic material such as rubber or plastic and is inserted into the valve hole 25 so that no portion of the valve cover 27 extends below the plane of the outer surface 16 of the bottom wall 12. This valve cover 27 keeps dirt, water, and other such contaminants from coming into contact with the inlet valve 23 or the relief valve 24.

To accommodate delivery of pressurized air from an external source of air, an access passage 28 would be drilled through the valve cover 27 associated with the inlet valve 23. Since the material composing the valve cover 27 is soft and elastic, the access passage 28 would expand to permit the user to push the air hose, air needle, air valve, or other such delivery mechanism through the valve cover 27 and connect the delivery mechanism to the inlet valve 23 and thereby pressurize the container 10. When the container 10 has been pressurized, the delivery mechanism is disconnected from the inlet valve 23 and withdrawn back through the access passage 28. Since the material composing the valve cover 27 is soft and elastic, the access passage 28 would remain open to permit the user to withdraw the air hose, air needle, air valve, or other such delivery mechanism and then collapse upon itself and close, thereby maintaining the protective cover over the inlet valve 23. To accommodate the air escaping through the relief valve 24, an egress passage 29 would be drilled through the valve cover 27 associated with the relief valve 24. The egress passage 29 would expand and open to permit escaping air to pass through the valve cover 27 in the event of over-pressurization of the container 10. When no more air is trying to escape, the egress passage 29 collapses upon itself and closes thereby maintaining the protective cover over the relief valve 24.

In another variant of the preferred embodiment, the valve cover 27 is removable in which case it would be composed of a soft elastic material that would permit the user to simply stuff the valve cover 27 into the valve hole 25 when not pressurizing the container 10 and removing the valve cover 27 with the thumb and forefinger when it becomes necessary to pressurize the container 10.

While economics and market forces may suggest a cylindrical container 10 sized to accommodate three tennis balls, the present invention contemplates no such restrictions. Accordingly, the shape of the container 10 can be cylindrical, rectangular, spherical, pyramidal, or any other geometric shape that will support the concept of a container 10 with an airtight cover 11 and an inlet valve 24 and a relief valve 25 embedded in the bottom wall 12 of the container 10. Similarly, the container 10 can be sized to accommodate and pressurize any number of tennis balls, racket-balls, squash balls, basketballs, or any other such athletic balls. While larger containers may permit embedding the inlet valve 24 and the relief valve 25 on the exterior side of the bottom wall 12 or even the side wall 13, the unique features of the present invention, embedded and protected fixtures, continue to characterize these variations.

DESCRIPTION

Alternative Embodiment

Figure 5:
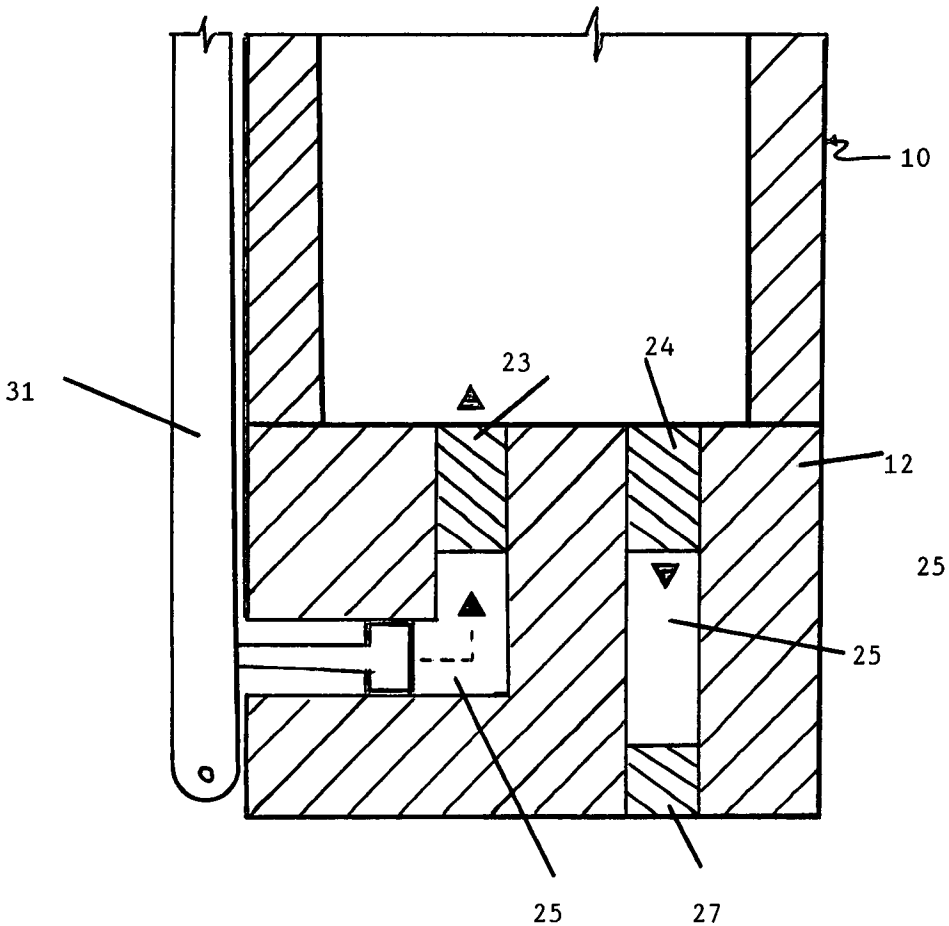
FIG. 5 is a cross-sectional view of another embodiment of the present invention.

FIG. 5 shows another embodiment of the present invention having an attached internal gas pump 30 that is embedded in the bottom wall 12. This attached internal gas pump 30 permits the user to pressurize the container 10 without having to rely upon a separate, external source of air. The attached internal gas pump 30 can vary in design and complexity, depending upon the needs and budget of the user and the size of the container. FIG. 5 shows an attached internal gas pump 30 that is little more than a compressible elastic dome with a hole in the top that forces air through the inlet valve 23 when the user compresses the elastic dome. In this particular configuration, the attached internal gas pump 30 (the collapsible dome) also functions as an additional valve cover 27 for the inlet valve 23.

The attached internal gas pump 30 could also be configured as, without limitation, a hand-pump, a lever arm with a piston and cylinder arrangement, a compression head with a piston and cylinder arrangement, an electrical or battery-powered air compressor, or any other such pumping means that will fit completely inside the bottom wall 12.

DESCRIPTION

Alternative Embodiment

Figure 6:
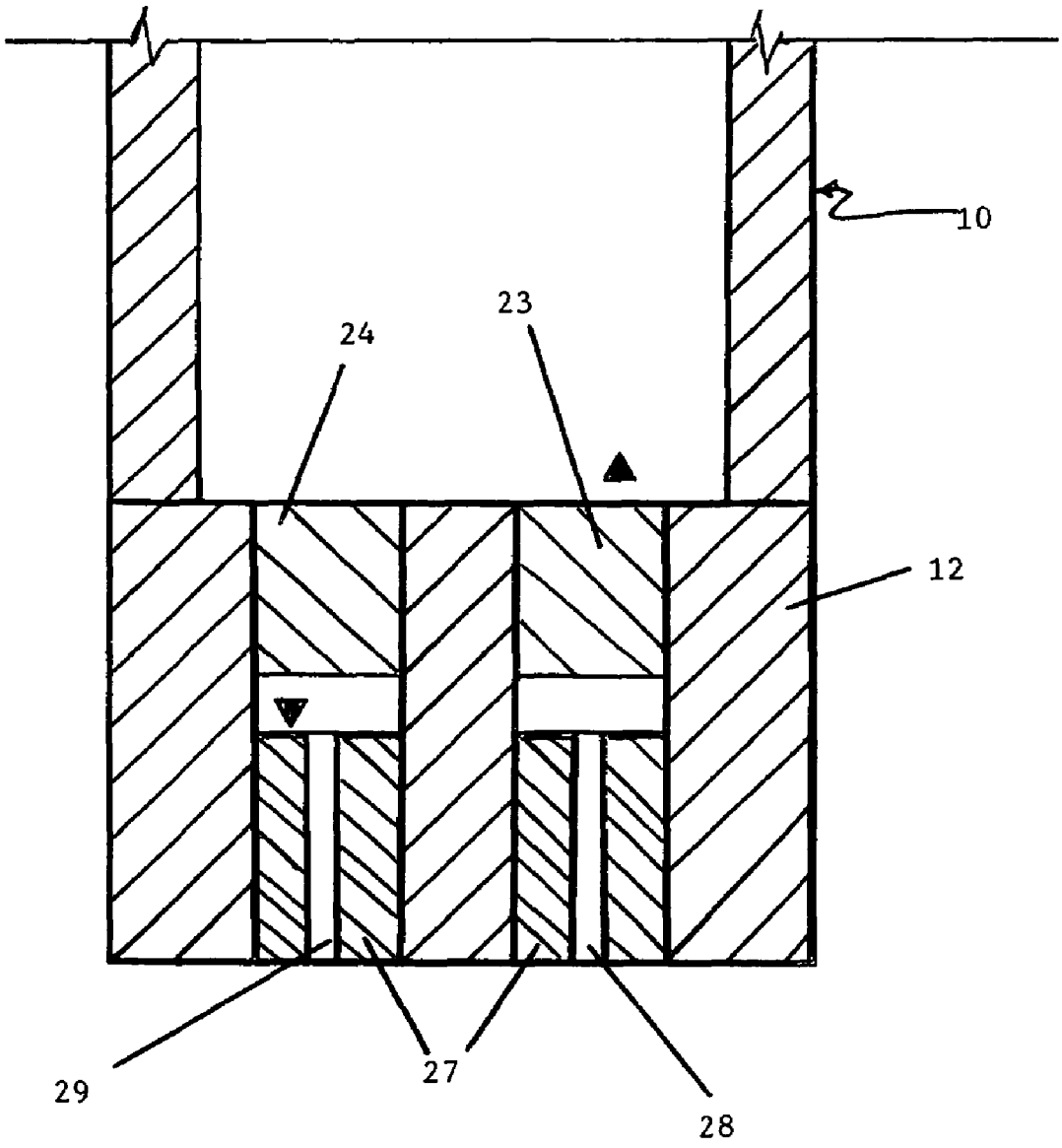
FIG. 6 is a cross-sectional view of another embodiment of the present invention.

FIG. 6 shows another embodiment of the present invention having an attached external gas pump 31 that is attached to the side wall outer surface 18. This alternative embodiment also permits the user to pressurize the container 10 without having to rely upon a separate, external source of air. The attached external gas pump 31 can vary in design and complexity, depending upon the needs and budget of the user and the size of the container. FIG. 6 shows an attached external gas pump 31 that is little more than a hand-pump. The attached internal gas pump 31 could also be configured as, without limitation, another type of hand-pump, a lever arm with a piston and cylinder arrangement, a compression head with a piston and cylinder arrangement, an electrical or battery-powered air compressor, or any other pumping means that can be attached to the side wall 13 outer surface 18.

OPERATION

Preferred Embodiment

The user, upon finishing the athletic activity associated with the athletic ball(s) to be stored in the container 10, would simply twist the cover 11 in a counter-clockwise direction to remove it from the container 10, deposit the athletic balls into the container 10, place the cover 11 back on the container 10 near the top end 14 so that the external male threads 19 on the side wall's 13 outer surface 18 slide into and engage the internal female threads 22 found on the cover's 11 side wall 113 inner surface 20, and then secure the cover 11 to the container 10 by twisting the cover 11 in a clockwise direction.

To pressurize the athletic balls stored inside the container 10, the user would simply push the pressurizing hose's attachment cap or inflating needle through the access passage 28 and attach it to the inlet valve 23. The user would then securely fasten the pressurizing hose from a separate and detached air compressor to the inlet valve 23 so as to form a tight seal between the pressurizing hose and the inlet valve 23. If the inlet valve 23 is an off-the-shelf variety of the type commonly found on automobile and bicycle tires, the user would screw the pressurizing hose's attachment cap onto the grooves found at the top of such commonly available inlet valves. Alternatively, if the user is in a hurry he or she could simply cover the inlet valve 23 with the pressurizing hose's attachment cap. If the inlet valve is an off-the-shelf variety of the type commonly found on inflatable athletic balls, the user would simply insert the inflating needle attached to the end of the pressurizing hose through the hole found in such commonly available inlet valves. After the discharge hose has been fastened to the inlet valve 23, the user would pressurize the container 10 to the desired pressure level. When the container 10 is pressurized to the desired level, the user would disconnect the pressurizing hose from the inlet valve 23 and withdraw it back through the access passage 28 which would then collapse upon itself and close so as to maintain provide a protective cover over the inlet valve 23. Should the user inadvertently pressurize the container 10 above the desired pressure setting, the relief valve 24 would open and allow air to escape through the egress passage 29 so as to reduce the pressure inside the container 10 to the desired level. When the air pressure inside the container 10 is at its desired level, the relief valve 24 will close and the egress passage 29 would then collapse upon itself and close so as to maintain provide a protective cover over the relief valve 24.

In the embodiment where the valve covers 27 are removable, the user would lift the valve cover 27 protecting the inlet valve 23 out of the valve hole 25 housing the inlet valve 23. Similarly, the user would lift the valve cover 27 protecting the relief valve 24 out of the valve hole 25 housing the relief valve 24. The user would then securely fasten the pressurizing hose from a separate and detached air compressor to the inlet valve 23 so as to form a tight seal between the pressurizing hose and the inlet valve 23. If the inlet valve 23 is an off-the-shelf variety of the type commonly found on automobile and bicycle tires, the user would screw the pressurizing hose's attachment cap onto the grooves found at the top of such commonly available inlet valves. Alternatively, if the user is in a hurry he or she could simply cover the inlet valve 23 with the pressurizing hose's attachment cap. If the inlet valve is an off-the-shelf variety of the type commonly found on inflatable athletic balls, the user would simply insert the inflating needle attached to the end of the pressurizing hose through the hole found in such commonly available inlet valves. After the pressurizing hose has been fastened to the inlet valve 23, the user would pressurize the container 10 to the desired pressure level. When the container 10 is pressurized to the desired level, the user would disconnect the pressurizing hose from the inlet valve 23 and reinsert the valve cover 27 into the valve hole 25. Should the user inadvertently pressurize the container 10 above the desired pressure setting, the relief valve 24 would open and reduce the pressure inside the container 10 to the desired level. Should the user forget to remove the valve cover 27 covering the relief valve 24, that particular valve cover would simply pop out to allow the air to escape.

In both configurations, the inlet valve 23 and the relief valve 24 are protected from damage and contamination. Embedding the valves in the bottom wall 12 protects the valves from damage typically found on protruding fixtures including, without limitation, bending, breaking, misalignment, falling out of calibration, etc. Further, since the valves are imbedded in the bottom wall 12 as opposed to the cover 11, they are protected from the type of damage typically associated with valves housed in the removable tops of pressurized containers including, without limitation, bending, breaking, misalignment, falling out of calibration, caused by dropping or slamming the removable top. Further still, the valves are imbedded in the bottom wall 12 (as opposed to the cover 11) which is far less likely to be lost, misplaced, purloined, kicked, or stepped on.

OPERATION

Alternative Embodiments

Figure 4:
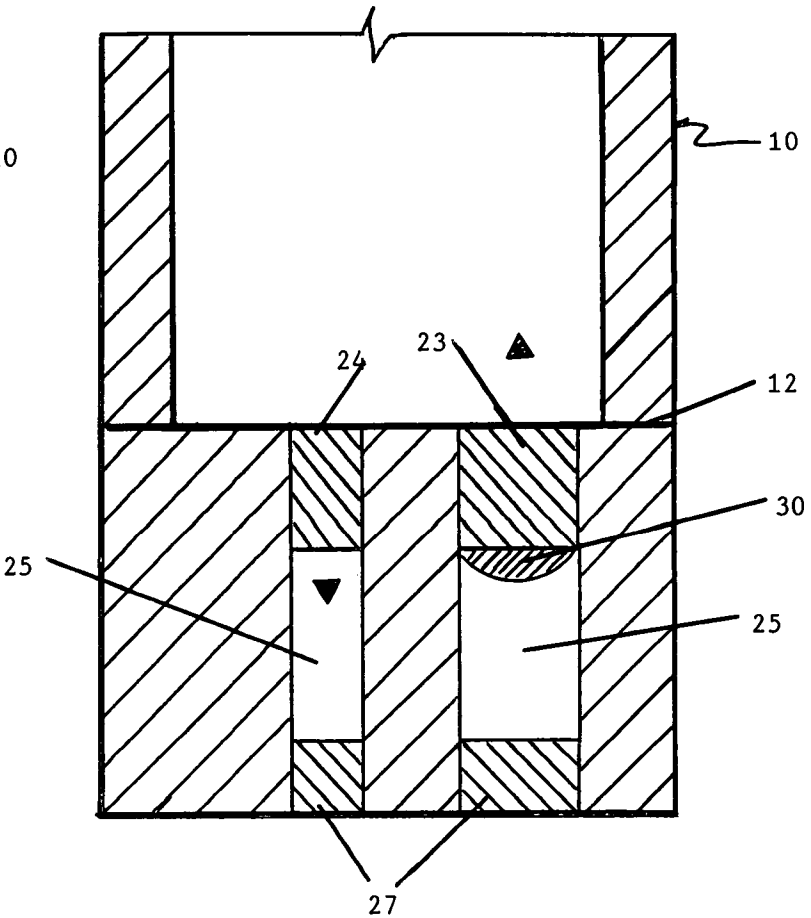
FIG. 4 is a cross-sectional view of the present invention with permanently embedded valve covers.

In the alternative embodiment depicted in FIG. 4, the user would attach the cover 11 to the container-10 as with the preferred embodiment. However, to pressurize the container 10, the user would remove the valve cover 27 protecting the inlet valve 23 which, in this embodiment, is covering the attached internal gas pump 30 which, in this particular configuration, is a flexible and elastic hemispheric dome with a small hole in the top. Similarly, the user-would lift the valve cover 27 protecting the relief valve 24 out of the valve hole 25 housing the relief valve 24. The user would then simply depress and collapse the dome with his or her thumb or finger, being sure to cover the hole in the top, so as to force air through the inlet valve 23 and into the container 10. Because of its elasticity, the dome would snap back into its original shape and the user would repeat this process until the pressure in the container 10 has reached the desired level. The user would then replace the valve covers 27 and transport the pressurized container to the next desired location. Should the user forget to remove the valve cover 27 covering the relief valve 24, that particular valve cover would simply pop out to allow the air to escape.

In another variation of this embodiment, the attached internal gas pump 30 (the hemispheric dome) also serves as the valve cover 27 so the steps of removing and replacing the valve cover-27 over the inlet valve 23 would be eliminated.

In the alternative embodiment depicted in FIG. 5, the user would attach the cover 11 to the container 10 as with the preferred embodiment. As with the other embodiments of the present invention, the user would lift the valve cover 27 protecting the inlet valve 23 out of the valve hole 25 housing the inlet valve 23. Similarly, the user would lift the valve cover 27 protecting the relief valve 24 out of the valve hole 25 housing the relief valve 24. However, to pressurize the container 10, the user would simply operate the attached external gas pump 31 until the pressure inside the container 10 is at the desired level. The user would then replace the valve covers 27 and transport the pressurized container to the next desired location.

CONCLUSIONS, RAMIFICATIONS, AND SCOPE

The present invention is an improved apparatus and method for extending the life of tennis balls and the like by storing such athletic balls in a pressurized portable container having protected inlet and relief valves embedded in the body of the container itself. The present invention represents a significant improvement over those inventions disclosed in the prior art by: (1) using an external source to pressurize the container; (2) minimizing the risk of damage to the attached or embedded fixtures, valves, gauges, and the like by embedding such fixtures in the body of the container instead of the removable cap or cover; (3) fully protecting the fixtures, valves, gauges, and the like from contamination by dirt, dust, water, and the like; (4) eliminating the use of gaskets to maintain an airtight seal; and (5) using off-the-shelf components for fixtures, valves and the like instead of complex, specially designed attachments.

These improvements provide the user with a device that is easier to operate and more affordable than similar devices disclosed by the prior art. The present invention is simple in design and construction which makes it easy to use and economical to manufacture. The present invention uses off-the-shelf components which, again, make it economical to manufacture. Finally, the present invention minimizes the exposure of vital components to damage which, in turn, extends the useful life of the device and thereby, presents a significant saving to the user who is no longer faced with necessity of replacing the device.

What is claimed is:

1. An improved apparatus for extending the life of athletic balls comprising:

a. a generally cylindrical hollow container closed at one end by a bottom wall and open at its top end, b. a removable cover, c. a means for attaching said cover to said container at said top end so as to create an airtight seal between said container and said cover, d. an air pressure relief valve connected to said container and embedded in an airtight manner in a valve hole cut all the way through said bottom wall, e. an air pressure inlet valve connected to said container and embedded in an airtight manner in another valve hole cut all the way through said bottom wall, and f. two generally solid, cylindrically-shaped valve covers composed of a soft, durable, elastic material, with one of said valve covers snugly inserted into said valve hole containing said relief valve and another of said valve covers snugly inserted into said valve hole containing said inlet valve, with both of said valve covers inserted in such a manner that no portion of either of said valve covers extends below said bottom wall's outer surface.

2. The improved apparatus for extending the life of athletic balls according to claim 1 wherein said valve covers are removable.

3. The improved apparatus for extending the life of athletic balls according to claim 1 wherein:

a. said valve cover covering said inlet valve has an access passage drilled all the way through said valve cover in such a manner that said access passage will expand to permit access to said inlet valve but collapse upon itself when access is no longer desired, b. said valve cover covering said relief valve has an egress passage drilled all the way through said valve cover in such a manner that said egress passage will expand to permit passage of air escaping from said relief valve but collapse upon itself when passage of escaping air is no longer necessary, and c. said valve covers are permanently embedded in said valve holes.

4. The improved apparatus for extending the life of athletic balls according to claim 1 further comprising an internal gas pump completely embedded within said bottom wall and attached to said inlet valve so as to generate a positive pressure inside said container when said gas pump is activated.

5. The improved apparatus for extending the life of athletic balls according to claim 1 further comprising an external gas pump permanently attached to said side wall's outer surface and having a means for attaching said external gas pump to said inlet valve so as to generate a positive pressure inside said container when said external gas pump is activated.

6. The improved apparatus for extending the life of athletic balls according to claim 1 wherein said means for attaching said cover to said container at said top end so as to create an airtight seal between said container and said cover consists of internal female threads machined, molded, or cast on said cover's side wall's inner surface so as to easily engage and mate with external male threads machined, molded, or cast on said top end of said container's side wall's outer surface.

7. The improved apparatus for extending the life of athletic balls according to claim 1 wherein said container and said cover are composed of dissimilar materials.

8. The improved apparatus for extending the life of athletic balls according to claim 2 wherein said container and said cover are composed of dissimilar materials.

9. The improved apparatus for extending the life of athletic balls according to claim 3 wherein said container and said cover are composed of dissimilar materials.

10. The improved apparatus for extending the life of athletic balls according to claim 4 wherein said container and said cover are composed of dissimilar materials.

11. The improved apparatus for extending the life of athletic balls according to claim 5 wherein said container and said cover are composed of dissimilar materials.

12. The improved apparatus for extending the life of athletic balls according to claim 6 wherein said container and said cover are composed of dissimilar materials.

13. The improved apparatus for extending the life of athletic balls according to claim 6 wherein said valve covers are removable.

14. The improved apparatus for extending the life of athletic balls according to claim 6 wherein:

a. said valve cover covering said inlet valve has an access passage drilled all the way through said valve cover in such a manner that said access passage will expand to permit access to said inlet valve but collapse upon itself when access is no longer desired, b. said valve cover covering said relief valve has an egress passage drilled all the way through said valve cover in such a manner that said egress passage will expand to permit passage of air escaping from said relief valve but collapse upon itself when passage of escaping air is no longer necessary, and c. said valve covers are permanently embedded in said valve holes.

15. The improved apparatus for extending the life of athletic balls according to claim 6 further comprising an internal gas pump completely embedded within said bottom wall and attached to said inlet valve so as to generate a positive pressure inside said container when said gas pump is activated.

16. The improved apparatus for extending the life of athletic balls according to claim 6 further comprising an external gas pump permanently attached to said side wall's outer surface and having a means for attaching said external gas pump to said inlet valve so as to generate a positive pressure inside said container when said external gas pump is activated.

17. A method for extending the life of athletic balls comprising the steps of:

a. placing athletic balls in a generally cylindrical hollow container closed at one end by a bottom wall and open at its top end, b. securely attaching a cover to said container so as to create an airtight seal between said container and said cover, c. pushing an attachment cap attached to an air hose hooked up to an external air compressor through an access passage drilled through an elastic valve cover inserted in a valve hole drilled through said bottom wall, d. attaching said attachment cap to an air pressure inlet valve connected to said container and embedded in an airtight manner in said valve hole cut all the way through said bottom wall, e. pressurizing said container to a desired pressure, f. detaching said attachment cap from said inlet valve, and g. pulling said attachment cap back through said access passage and thereby allowing said access passage to collapse upon itself.

18. A method for extending the life of athletic balls comprising the steps of:

a. placing athletic balls in a generally cylindrical hollow container closed at one end by a bottom wall and open at its top end, b. securely attaching a cover to said container so as to create an airtight seal between said container and said cover, c. removing an elastic valve cover inserted in a valve hole drilled through said bottom wall so as to expose an air pressure inlet valve connected to said container and embedded in an airtight manner in said valve hole cut all the way through said bottom wall, d. attaching an attachment cap attached to an air hose hooked up to an external air compressor to said inlet valve, e. pressurizing said container to a desired pressure, f. detaching said attachment cap from said inlet valve and g. replacing said valve cover in said valve hole.

* * * * *